US006659732B2

(12) United States Patent
Seo

(10) Patent No.: US 6,659,732 B2
(45) Date of Patent: Dec. 9, 2003

(54) SUPERCHARGING DEVICE OF HERMETIC COMPRESSOR

(75) Inventor: Seung-don Seo, Kwangju (KR)

(73) Assignee: Samsung Gwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 10/040,045

(22) Filed: Nov. 7, 2001

(65) Prior Publication Data

US 2002/0069667 A1 Jun. 13, 2002

(51) Int. Cl.[7] ..... F04B 23/08
(52) U.S. Cl. ..... 417/205; 417/902; 62/498
(58) Field of Search ..... 417/205, 16, 312, 417/415, 902, 540, 541, 542; 62/498, 216, 296, 505

(56) References Cited

U.S. PATENT DOCUMENTS 4,392,789 A * 7/1983 Bar ..... 417/312
4,990,067 A * 2/1991 Sasano et al. ..... 417/312
5,221,191 A * 6/1993 Leyderman et al. ..... 417/312
5,464,332 A * 11/1995 Beck et al. ..... 417/368
6,176,688 B1 * 1/2001 Collings et al. ..... 417/312
6,435,841 B1 * 8/2002 Kim ..... 417/363

* cited by examiner

*Primary Examiner*—Cheryl J. Tyler
*Assistant Examiner*—Han L Liu
(74) *Attorney, Agent, or Firm*—Jeffrey D. Moy; Harry M. Weiss; Weiss, Moy & Harris, P.C.

(57) ABSTRACT

A supercharging device of a hermetic compressor comprises a suction chamber connected with a suction pipe and a cylinder, the suction chamber formed at lower side of a cylinder block; a suction fan rotatably disposed in the suction chamber; a driving pulley disposed on a lower end of a crankshaft; a driven pulley disposed on a rotating shaft of the suction fan; and a belt connecting the driving pulley and the driven pulley. Accordingly, the suction fan rotates with the crankshaft, and moves the refrigerant in the suction chamber to the cylinder, and thus the amount of the refrigerant drawn into the cylinder is increased and consequently the volume efficiency of the compressor is increased.

7 Claims, 4 Drawing Sheets

SUPERCHARGING DEVICE OF HERMETIC COMPRESSOR

BACKGROUND OF THE INVENTION

1. Field of the Invention

The present invention relates to a hermetic compressor, and more particularly to a supercharging device of the hermetic compressor capable of supplying a great deal of refrigerant into a cylinder.

2. Description of the Related Art

Generally, a hermetic compressor is widely used for compressing refrigerant in a freezing apparatus such as a refrigerator.

As shown in FIG. 1, a reciprocating compressor as one of the hermetic compressors comprises an electric driving unit and a compressing unit. The compressing unit is used for compressing the refrigerant by being driven by the electric driving unit in a sealed casing 1.

The electric driving unit comprises a stator 10, a rotor 20 for being rotated by an electromagnetic interaction with the stator 10, and a crankshaft 21 installed at a center of the rotor 20.

The compressing unit comprises a cylinder block 40, a connecting rod 31 eccentrically connected with a lower part of the crankshaft 21, a piston 32 that linearly reciprocates in a cylinder 41 formed in the cylinder block 40 by being connected with a front end of the connecting rod 31, and a cylinder head 43 for sealing the cylinder 41. A valve assembly 42 is disposed between the cylinder head 43 and the cylinder 41. The valve assembly 42 includes a suction valve (not shown) and a discharge valve (not shown) for controlling a flow of the refrigerant between the cylinder head 43 and the cylinder 41.

A suction muffler 50, connected with one side of the cylinder head 43, is disposed at an upper part of the cylinder head 43. A refrigerant suction pipe 51, for drawing in the refrigerant from an evaporator (not shown) of the freezing apparatus, is connected with the suction muffler 50. On the other hand, a discharge muffler 60, connected with the other side of the cylinder head 43, is disposed at a lower side of the cylinder block 40.

For a compressor having the above construction, since the piston 32 reciprocates between an upper dead point and a lower dead point in the cylinder 41 by a rotation of the crankshaft 21, the refrigerant is drawn into the cylinder 41 and discharged to outside of the cylinder 41 after being compressed. In other words, the refrigerant is drawn into the cylinder head 43 after orderly passing through the evaporator, the suction pipe 51 and the suction muffler 50. When the suction valve (not shown) formed at the valve assembly 42 is opened, the refrigerant is drawn into the cylinder 41. After that, when the discharge valve (not shown) is opened, the refrigerant compressed in the cylinder 41 is discharged to the cylinder head 43, and flows to a condenser (not shown) of the freezing apparatus through the discharge muffler 60.

However, for the reciprocating compressor with the above construction, a general amount of the refrigerant drawn into the cylinder is only 60 to 70% compared to an amount of the refrigerant discharged by the piston 32. In other words, in a conventional reciprocating compressor, volume efficiency is 60 to 70%. The low volume efficiency is due to leakage of the refrigerant between the valve assembly 42 and the cylinder 41 and between the piston 32 and the cylinder 41, clearance volume formed between an upper end of the piston 32 and the valve assembly 42 when the piston reaches the upper dead point, and expansion of the refrigerant by the temperature inside of the cylinder 41.

When the volume efficiency is low, the compressing efficiency of the compressor is also low, thus the volume efficiency should be increased for a compressor with a high efficiency.

SUMMARY OF THE INVENTION

The present invention has been made to overcome the above-mentioned problems of the related art. Accordingly, it is an object of the present invention to provide a supercharging device of a hermetic compressor capable of increasing a volume efficiency by drawing in a great deal of refrigerant to a cylinder.

The above object of the present invention is accomplished by providing a super charging device of a hermetic compressor comprising a suction chamber connected with a refrigerant suction pipe and the cylinder, wherein the suction chamber is formed at one side of a cylinder block; a suction fan rotatably disposed in the suction chamber for being rotated in accordance with a rotation of a crankshaft; and transmitting means for transmitting the rotation force of the crankshaft to the suction fan.

Here, the transmitting means comprises a driving pulley formed on the crankshaft; a driven pulley formed on a rotating shaft of the suction fan; and a belt connecting the driving pulley and the driven pulley. Alternatively, the transmitting means can comprise a driving gear formed on the crankshaft; a driven gear formed on the rotating shaft of the suction fan; and an idle gear connecting the driving gear and the driven gear.

On the other hand, the suction chamber comprises a cylindric body protruded from a lower side of the cylinder block and a semi-spherical cover for shielding the body.

According to the supercharging device of the present invention, since the suction fan is rotated by being connected with the crankshaft, and transmits the refrigerant of the suction chamber, the amount of the refrigerant drawn into the cylinder is increased, and consequently, the volume efficiency of the compressor is increased.

BRIEF DESCRIPTION OF THE DRAWINGS

The described objects and features of the present invention will be more apparent by explaining the preferred embodiment of the present invention by referring to the appended drawings, in which.

DETAILED DESCRIPTION OF THE PREFERRED EMBODIMENTS

Figure 1:
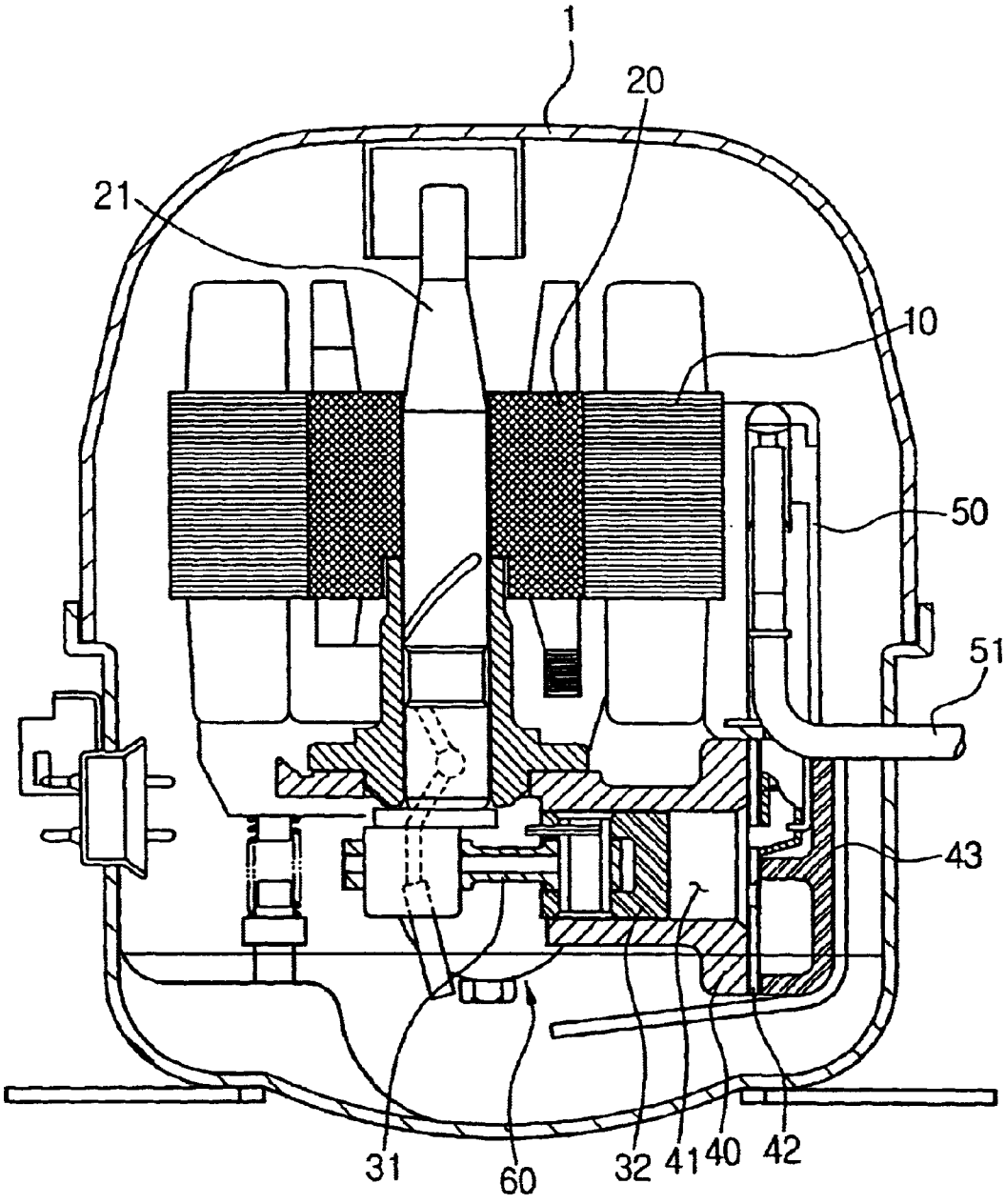
FIG. 1 (PRIOR ART)
FIG. 1 is a sectional view showing a conventional reciprocating compressor.

From now on, the preferred embodiments of the present invention will be described by referring to the accompanying drawings. However, a hermetic compressor having a supercharging device according to the present invention has almost the same construction with a conventional compressor, thus the same referential numerals will be given to the same part of FIG. 1, and the description will be omitted.

Figure 2:
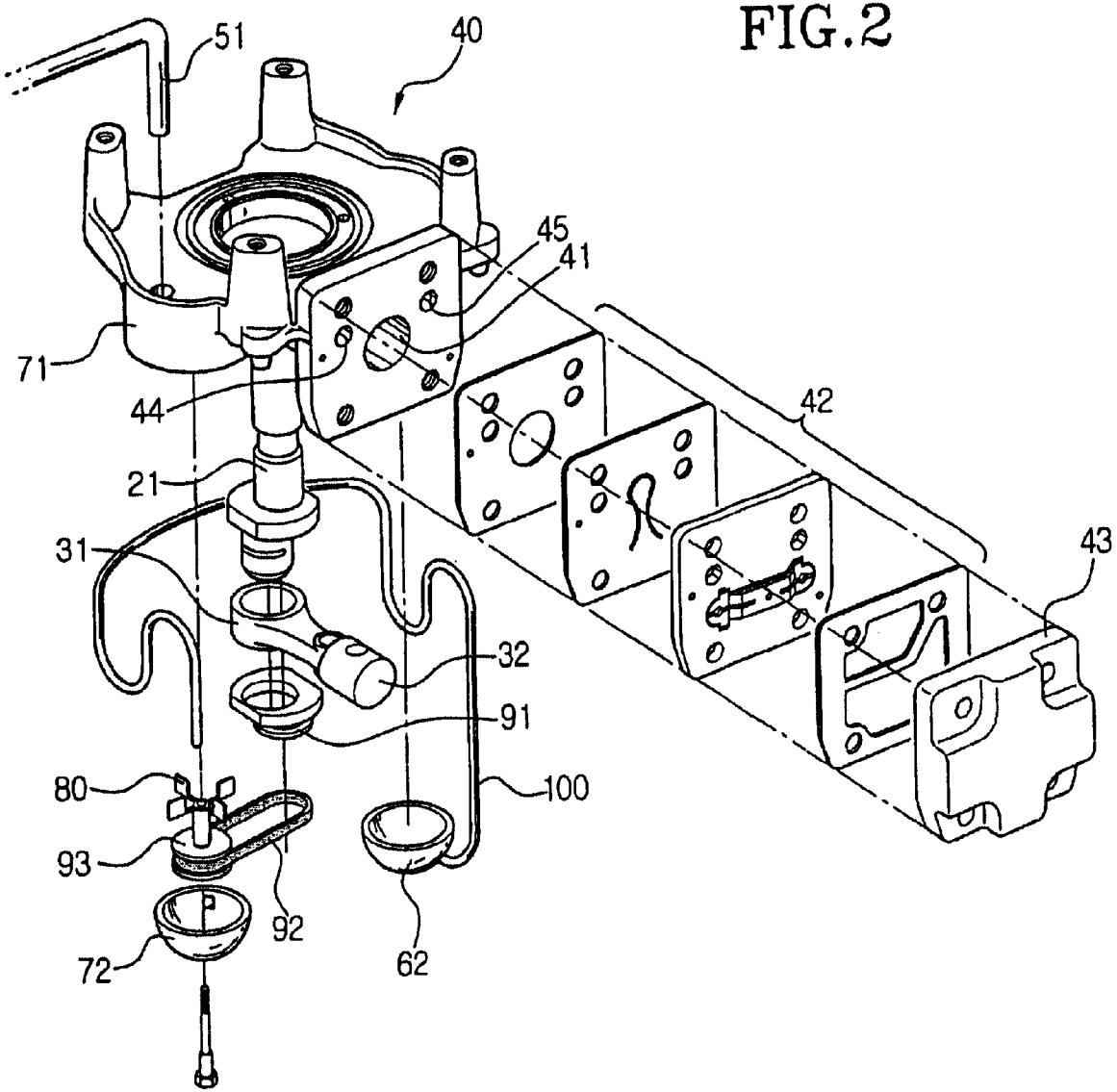
FIG. 2 is a partial exploded perspective view showing a compressor having a supercharging device according to one preferred embodiment of the present invention.

As shown in FIG. 2, a reciprocating compressor having the supercharging device according to the present invention comprises a cylinder block 40 having a cylinder 41 formed therein, a cylinder head 43 installed at a front of the cylinder block 40 for sealing the cylinder 41, and a valve assembly 42 disposed between the cylinder block 40 and the cylinder head 43.

A piston 32 connected with a crankshaft 21 by a connecting rod 31 is formed inside of the cylinder 41. The piston 32 compresses a refrigerant by reciprocating inside of the cylinder 41 with rotation of the crankshaft 21.

Figure 3:
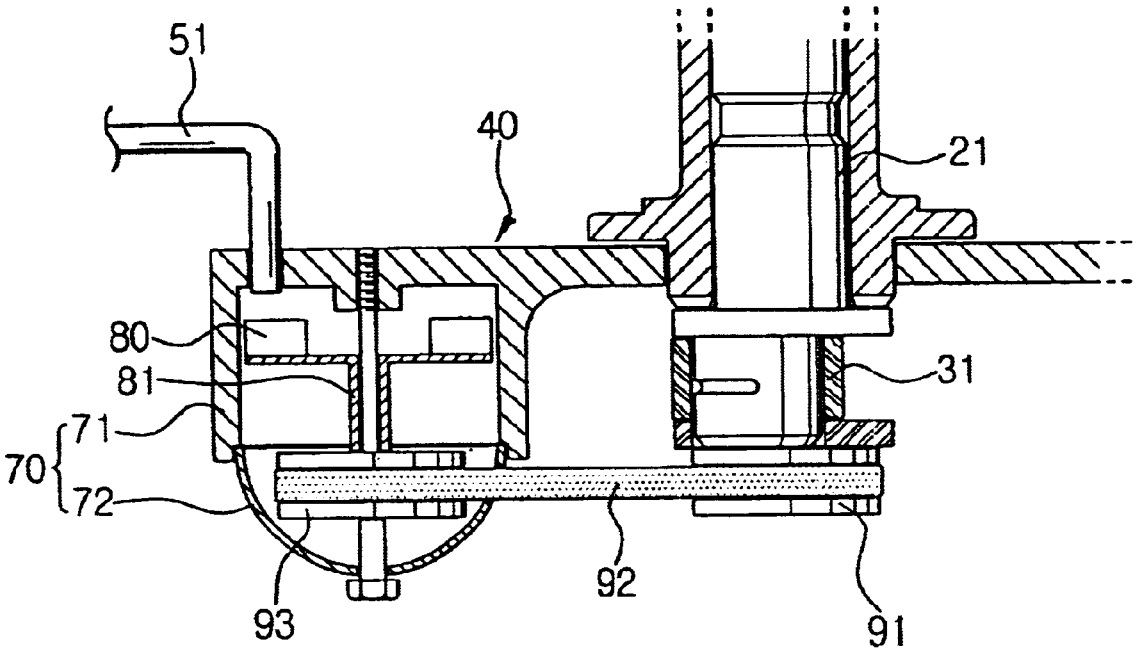
FIG. 3 is a sectional view showing connection status of the compressor of FIG. 2.

As shown in FIGS. 2 and 3, the supercharging device according to one preferred embodiment of the present invention comprises a suction chamber 70 having a body 71 cylindrically protruded from a lower part of the cylinder block 40, a semi-spherical cover 72 for sealing an opening of the body 71, and a suction fan 80 rotatably disposed in the suction chamber 70.

A driving pulley 91 is coaxially connected at a lower part of the crankshaft 21, and a driven pulley 93 is integrally connected at an end of a rotating shaft 81 of the suction fan 80. The driving pulley 91 and the driven pulley 93 are connected by a belt 92. The belt 92 may be a timing belt or a V belt. When the crankshaft 21 rotates, the driving pulley 91 also rotates. The rotation of the driving pulley 91 is transferred to the driven pulley 93 by the belt 92, and consequently, the suction fan 80 rotates in the suction chamber 70 with the rotation of the crankshaft 21.

On the other hand, the size of the driving pulley 91 and the driven pulley 93 are formed such that the suction fan 80 rotates approximately 0.5 to 2 times when the crankshaft 21 rotates one time. It is preferable that the driving pulley 91 and the driven pulley 93 are approximately the same size so that the suction fan 80 can rotate one time when the crankshaft 21 rotates one time.

Figure 4:
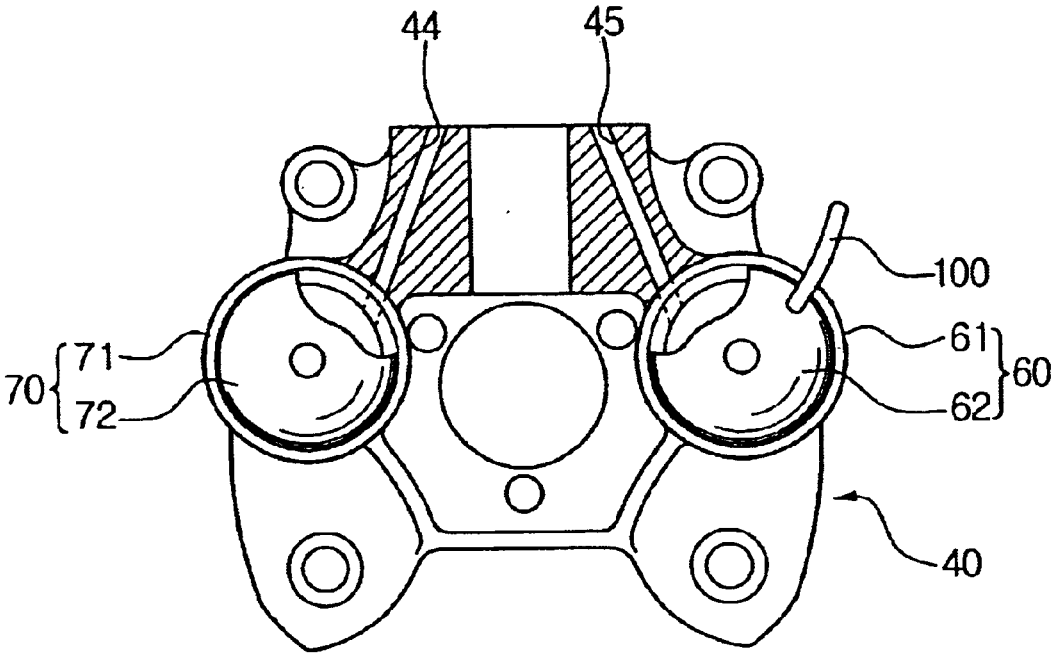
FIG. 4 is a bottom view showing a cylinder block partially cut of the compressor of FIG. 2.

As shown in FIG. 4, the suction chamber 70 is connected with the cylinder head 43 through a suction passage 44 penetrating one side of the body 71 and a front side of the cylinder block 40. In addition, the suction chamber 70 is connected with the evaporator (not shown) through a suction pipe 51 penetrating an upper side of the cylinder block 40. Therefore, the refrigerant drawn into the suction chamber 70 through the suction pipe 51 is drawn into the cylinder head 43 through the suction passage 44. The refrigerant in the cylinder head 43 is drawn into the cylinder 41 through the valve assembly 42, when the piston 32 moves to a lower dead point of the cylinder 41.

Meanwhile, a discharge muffler 60 is disposed in parallel to the suction chamber 70 at a lower side of the cylinder block 40. The discharge muffler 60 comprises a body 61 cylindrically protruded from a lower side of the cylinder block 40, and a semi-spherical cover 62 for sealing an opening of the body 61. The discharge muffler 60 is connected with the cylinder head 43 through a refrigerant discharge passage 45 penetrating the one side of the body 61 and the front side of the cylinder block 40. A refrigerant discharge pipe 100 is connected with the cover 62 for supplying the refrigerant to a condenser (not shown). Accordingly, the refrigerant in the cylinder 41 is drawn into the discharge muffler 60 by orderly passing through the cylinder head 43 and the discharging passage 45. After that, the refrigerant flows to the condenser through the discharge pipe 100.

For a compressor having the above construction, when the crankshaft 21 rotates, the piston 32 reciprocates in the cylinder 41, and the refrigerant is drawn into the cylinder 41 after orderly passing through the suction pipe 51, the suction chamber 70 and the cylinder head 43. At this time, the suction fan 80 rotates in the suction chamber 70 in accordance with the rotation of the crankshaft 21. The refrigerant is drawn into the suction chamber 70 through the suction pipe 51 and flows to the inside of the cylinder 41. As described above, since the suction fan 80 moves the refrigerant forcefully, the amount of the refrigerant drawn into the cylinder 41 is increased, and thus, the volume efficiency of the compressor can be increased almost around 90%.

Figure 5:
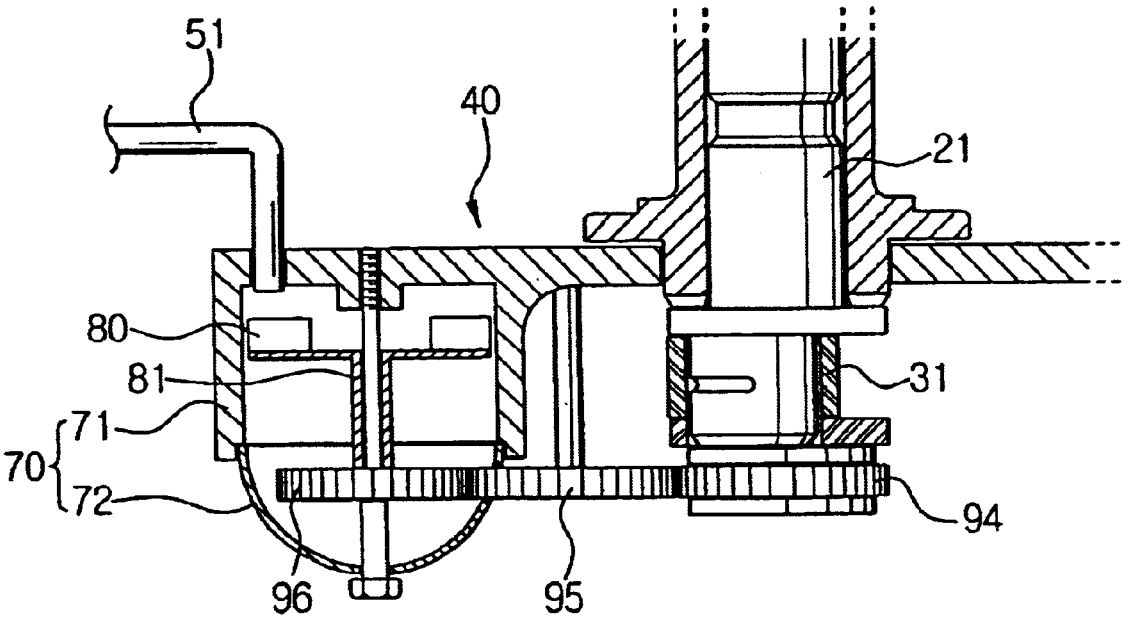
FIG. 5 is a partial sectional view showing a compressor having a supercharging device according to another preferred embodiment of the present invention.

FIG. 5 shows a supercharging device according to another preferred embodiment of the present invention.

As shown in FIG. 5, the supercharging device according to another preferred embodiment has a difference in transmitting the rotation of the crankshaft 21 to the suction fan 80 compared to the supercharging device of FIG. 2. In other words, a driving gear 94 is coaxially connected with a lower end of the crankshaft 21, and a driven gear 96 is integrally connected with a rotating shaft of the suction fan 80. The driving gear 94 and the driven gear 96 are connected by an idle gear 95. When the crankshaft 21 rotates, the driving gear 94, the idle gear 95 and the driven gear 96 rotate, and accordingly, the suction fan 80 rotates in the suction chamber 70.

As described above, according to the supercharging device of the present invention, since the suction fan 80 rotates with the crankshaft 21 and moves the refrigerant in the suction chamber 70 to the cylinder 41, the amount of the refrigerant drawn into the cylinder 41 is increased and consequently, the volume efficiency of the compressor is also increased.

Moreover, for a compressor having the supercharging device according to the present invention unlike a conventional compressor, noise generated when the refrigerant is drawn is reduced in the suction chamber 70. Thus a separate suction muffler (refer to 50 of FIG. 1) is not needed. Therefore, the number of parts is reduced, and thus the production cost will be lowered.

Although the preferred embodiments of the present invention have been described, it will be understood by those skilled in the art that the present invention should not be limited to the described preferred embodiments, and various changes and modifications can be made within the spirit and scope of the present invention as defined by the appended claims.

What is claimed is:

1. A supercharging device for increasing volume efficiency of a hermetic compressor, the supercharging device comprising:

a suction chamber connected with a refrigerant suction pipe and a cylinder of the hermetic compressor, the suction chamber formed at one side of a cylinder block of the hermetic compressor for increasing volume efficiency;

a suction fan rotatably disposed in the suction chamber; and driving means coupled to the suction fan for driving the suction fan.

2. The supercharging device of a hermetic compressor of claim 1, wherein the suction chamber comprises:

a cylindric body protruded from a lower side of the cylinder block; and a semi-spherical cover for sealing the body.

3. A supercharging device for increasing volume efficiency of a hermetic compressor, the supercharging device comprising:

a suction chamber connected with a refrigerant suction pipe and a cylinder of the hermetic compressor, the suction chamber formed at one side of a cylinder block of the hermetic compressor for increasing volume efficiency;

a suction fan rotatably disposed in the suction chamber for being rotated in accordance with rotation of a crankshaft; and transmitting means for transmitting the rotation force of a crankshaft to the suction fan.

4. The supercharging device of a hermetic compressor of claim 3, wherein the transmitting means comprises:

a driving pulley disposed on the crankshaft;

a driven pulley disposed on a rotating shaft of the suction fan; and a belt connecting the driving pulley and the driven pulley.

5. The supercharging device of a hermetic compressor of claim 4, wherein the transmitting means comprises:

a driving gear formed on the crankshaft;

a driven gear formed on the rotating shaft of the suction fan; and an idle gear connecting the driving gear and the driven gear.

6. The supercharging device of a hermetic compressor of claim 3, wherein the suction fan rotates 0.5 to 2 times per rotation of the crankshaft.

7. The supercharging device of a hermetic compressor of claim 3, wherein the suction chamber comprises:

a cylindric body protruded from a lower side of the cylinder block; and a semi-spherical cover for sealing the body.

* * * * *